US006552483B1

(12) United States Patent
Cho et al.

(10) Patent No.: US 6,552,483 B1
(45) Date of Patent: Apr. 22, 2003

(54) CATHODE-RAY TUBE HAVING IMPROVED YOKE MOUNTING PART

(75) Inventors: Hyun-Shik Cho, Seoul (KR); Jin-Hyeu Do, Seoul (KR); Won-Ho Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/566,816

(22) Filed: May 8, 2000

(30) Foreign Application Priority Data

May 10, 1999 (KR) ..... 99-16635
May 12, 1999 (KR) ..... 99-16977

(51) Int. Cl.[7] ..... H01J 29/70; H01J 29/76; H01J 31/00

(52) U.S. Cl. ..... 313/440; 313/413; 313/477 R; 220/2.1 A; 220/2.3 A; 335/210

(58) Field of Search ..... 313/440, 422, 313/421, 477 R, 413, 441; 220/2.1 A, 2.1 R, 2.3 A; 335/210, 213

(56) References Cited

U.S. PATENT DOCUMENTS 3,731,129 A * 5/1973 Tsuneta et al. ..... 313/403
5,763,995 A * 6/1998 Sano et al. ..... 313/477 R
5,929,559 A * 7/1999 Sano et al. ..... 220/2.1 A
5,962,964 A * 10/1999 Sano et al. ..... 313/440
6,087,767 A * 7/2000 Sano et al. ..... 220/2.1 A
6,268,692 B1 * 7/2001 Yokota et al. ..... 220/2.1 A
6,307,313 B1 * 10/2001 Fukuda ..... 313/421

FOREIGN PATENT DOCUMENTS

JP 2000149826 A * 5/2000 ..... H01J/29/86
JP 2000323070 A * 11/2000 ..... H01J/29/86

* cited by examiner

*Primary Examiner*—Nimeshkumar D. Patel
*Assistant Examiner*—Sikha Roy
(74) *Attorney, Agent, or Firm*—Fleshner & Kim, LLP

(57) ABSTRACT

The disclosed cathode-ray tube has a pyramidal yoke mounting part defined to extend from a joint with the neck to at least the end of a deflection yoke on the side of the screen, the yoke mounting part including: an inside profile having a form protruding towards a tubular axis in the direction of major and minor axes based on a diagonal axis so as to have a functional relation with a deflection angle; and an outside profile having a rectangular form with respect to the major and minor axes, the outside profile having a ratio of a maximum thickness to a minimum thickness on the same axis being either of the minor or major axis in the range from 1.0 to 1.5. It satisfies a relation $0.7<Rov/Roh\leqq 1.0$, wherein Roh is a radius of outer curvature in the direction of the major axis and Rov is a radius of outer curvature in the direction of the minor axis. Also, when a tubular axis ranging from the joint with the neck to the end of the deflection yoke is divided into equal "n" parts, a value of Td/Tv or Td/Th is in the range from 0.5 to 0.85, wherein Tv, Th and Td are thicknesses in the directions of minor, major and the diagonal axes, respectively, perpendicular to the tubular axis at each length-based position, thereby optimizing the thickness ratio and radii of curvature in the directions of the major and minor axes perpendicular to the tubular axis of the funnel or on the same axis and securing sufficient atmospheric pressure resistance without causing BSN according to wide-angle deflection.

26 Claims, 7 Drawing Sheets

【Fig. 7】
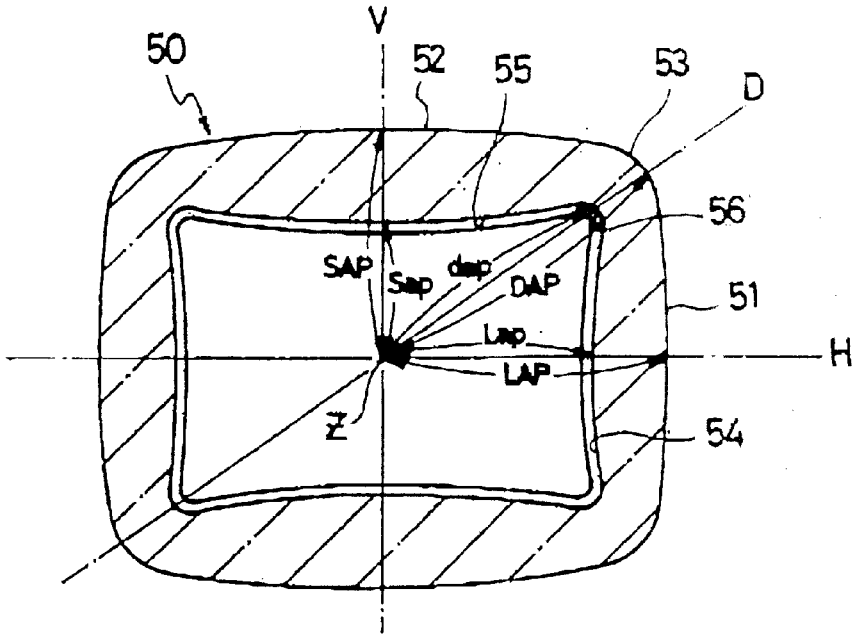
【Fig. 8】
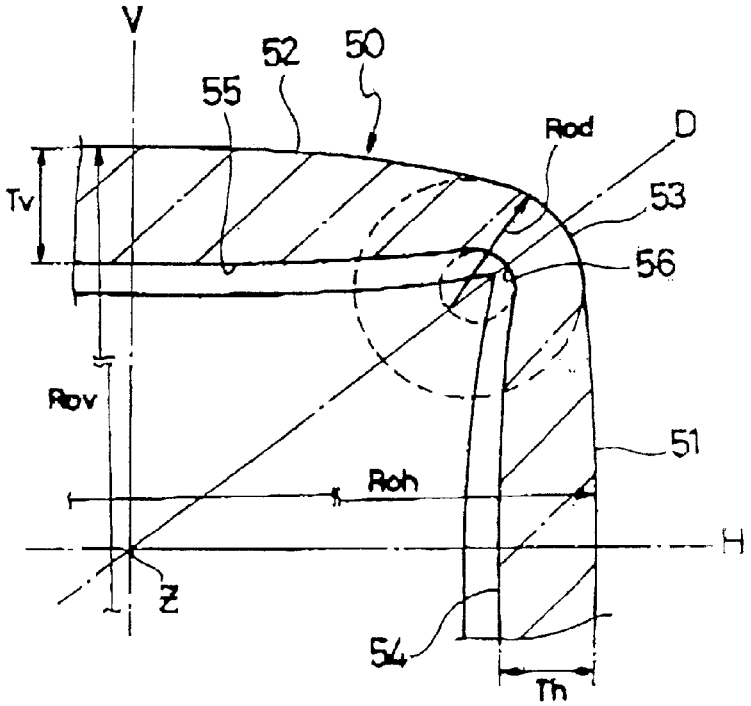

【Fig. 9】
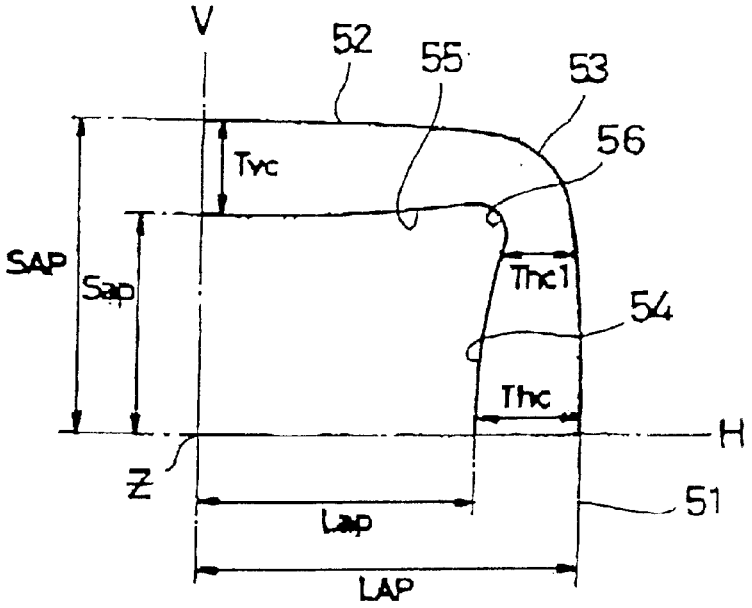
【Fig. 10】
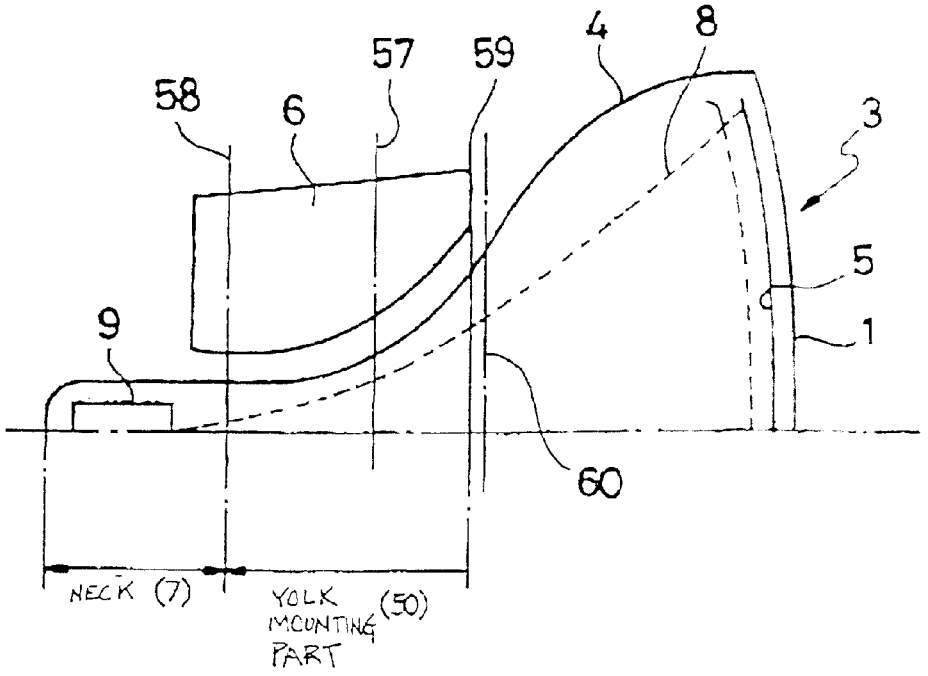

【Fig. 11】
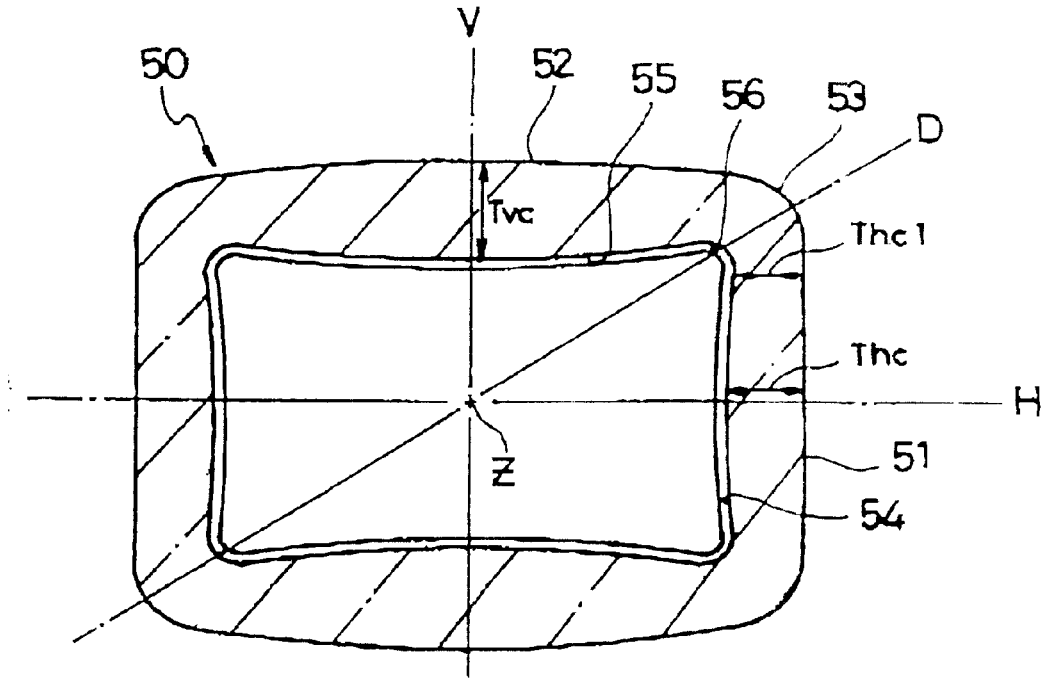
【Fig. 12】
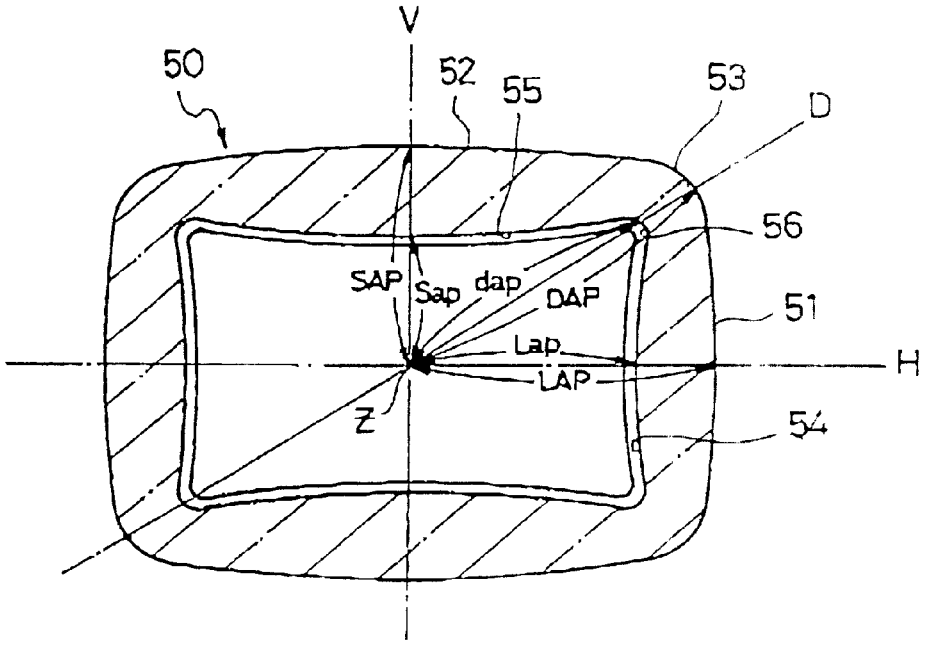

【Fig. 13】
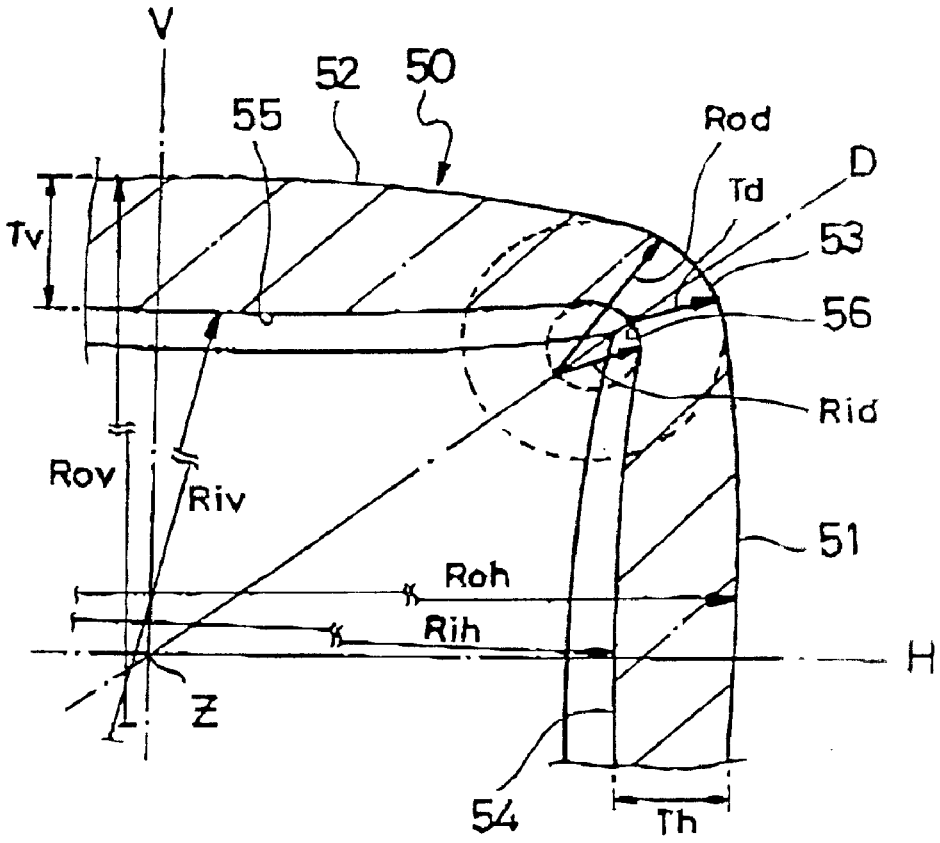

CATHODE-RAY TUBE HAVING IMPROVED YOKE MOUNTING PART

BACKGROUND OF THE INVENTION

1. Field of the Invention

The present invention relates to a cathode-ray tube for color picture tube color monitor and the like, and more particularly, to a cathode-ray tube having a yoke mounting part of a funnel in a pyramidal form for mounting a deflection yoke so as to both secure the margin of beam strike neck (BSN) according to wide-angle deflection and enhance atmospheric pressure resistance.

2. Background of the Related Art

In general, a color cathode-ray tube, for example, has an outer vacuum tube that comprises a glass face panel having an approximately rectangular display space, a glass funnel joined to the face panel, and a cylindrical glass neck joined to the funnel.

The neck is internally provided with electron guns emitting three electron beams, and a deflection yoke is provided around the circumference of the neck and the funnel.

The funnel has a yoke mounting part extending from the joint with the neck to the mount position of the deflection yoke.

An in-line type self-converging color cathode-ray tube is widely used that uses non-uniform magnetic fields in converging three in-line type electron beams over the whole screen without a separate compensator by deflecting three electron beams, emitted from electron guns in a line on the same horizontal plane, with a pincushion-shaped horizontal deflection magnetic field and a barrel-shaped vertical deflection magnetic field generated from the deflection yoke.

Such a general cathode-ray tube has the deflection yoke usually designed based on the funnel. However, in a pyramidal funnel and deflection yoke structure, the cone of the funnel, i.e., the yoke mounting part has to be designed to have an optimal inside profile as determined in consideration of the explosion characteristic and the BSN to the beam trajectory, the funnel being designed based on the deflection yoke in the order of deflection yoke design, deflection yoke profile modeling, magnetic field calculation, beam trajectory calculation, vacuum stress calculation at the funnel bulb, and deflection yoke shape modeling considering deflection sensitivity. This constraint on designing the yoke mounting part requires optimization in designing the outside profile of the funnel so as to enhance atmospheric pressure resistance in consideration of deflection sensitivity and explosion characteristic in a situation that the values related to the inside profile of the funnel are almost fixed.

A color cathode-ray tube is illustrated in FIGS. 1 and 2 as an example of the above-constructed conventional cathode-ray tube.

The color cathode-ray tube has an outer vacuum tube 10 made of glass.

The outer vacuum tube 10 comprises a face panel 3 having an approximately rectangular effective part 1 and a skirt part 2 provided in the periphery of the effective part 1, a funnel 4 joined to the skirt part 2, and a cylindrical neck 7 extending from the funnel 4.

The effective part 1 of the face panel 3 has an approximately rectangular form with horizontal and vertical axes H and V perpendicular to each other through a tubular axis Z of the cathode-ray tube.

And, a deflection yoke 6 is externally provided over an area ranging from the neck 7 to the funnel 4. The funnel 4 has a small-diameter region, so-called yoke mounting part 12 extending from the joint with the neck 7 to the mount position of the deflection yoke 6, i.e., extending to the side of the face panel 3.

On the inner surface of the effective part 1 of the face panel 3 are provided a fluorescent screen 5 comprising three dot or stripe type fluorescent layers emitting blue, green and red lights, and a stripe type light-shielding layer interposed between the fluorescent layers.

The outer vacuum tube 10 is internally provided with a shadow mask 11 as a dichroic electrode opposite to the fluorescent screen 5.

And, electron guns 9 emitting three electron beams 8 are provided in the neck 7. The three electron beams 8 emitted from the electron guns 9 are deflected by the horizontal and vertical magnetic fields generated from the deflection yoke 6, thus horizontally and vertically scanning the fluorescent screen 5 via the shadow mask 11 to form a color image on the screen 5.

The yoke mounting part 12 of the funnel 4 in which the deflection yoke 6 is mounted in the color cathode-ray tube has an approximately pyramidal form. Here, the deflection yoke 6 is of a saddle shape with less leakage magnetic field and comprises a cylindrical frame made of a synthetic resin for fixing horizontal and vertical deflecting coils and a core. More specially, the pyramidal yoke mounting part 12 has a circular cross section perpendicular to the tubular axis Z as the neck 7 around the joint with the neck 7 and an approximately rectangular cross section in conformity with the profile of the effective part 1 of the face panel 3, as shown in FIGS. 3 and 4, around the central portion along the tubular axis Z and the end portion on the side of the fluorescent screen 5.

As illustrated in FIG. 4, the cross section of the yoke mounting part 12 has the outside profile in an approximately rectangular form constituted by the continuity of a pair of circular arcs 20 for a horizontal radius Roh having a center on the horizontal axis H with respect to the effective part 1, a pair of circular arcs 21 for a vertical radius Rov having a center on the vertical axis V, and a pair of circular arcs 22 for a diagonal radius Rod having a center on the diagonal axis D.

That is, as shown in FIG. 3, the cross section of the yoke mounting part 12 has the inside profile with inner diameters La, Sa and da in the directions of horizontal (major), vertical (minor) and diagonal axes H, V and D, respectively, extending from the joint with the neck 7 to the end of the deflection yoke 6.

The yoke mounting part has, as also shown in FIG. 3, outer diameters DA, LA and SA in the directions of diagonal, horizontal (major) and vertical (minor) axes D, H and V, respectively, extending from the joint with the neck 7 to the screen side of the deflection yoke 6, i.e., the end of the deflection yoke 6.

As such, the cross section of the yoke mounting part 12 perpendicular to the tubular axis Z has the outside profile almost in the same circular form as the neck 7 around the joint with the neck 7, and in an approximately rectangular form on the side of the fluorescent screen 5 with a gradual decrease in the outer diameters LA and SA in the directions of the major and minor axes, respectively, with respect to the outer diameter DA in the direction of the diagonal axis D.

While on the other, the yoke mounting part 12 has the inside profile not in a perfect plane but in a pincushion form protruding in the direction of the tubular axis Z, as illustrated in FIG. 3. That is, the cross section perpendicular to the tubular axis Z of the yoke mounting part 12 has the inside profile not in a perfect rectangular form but in an imperfect rectangular form of which the sides form a convex curve protruding in the direction of the tubular axis Z.

Each short side 24 for the inside profile of the yoke mounting part 12 is in the form of a convex curve having an apical part on the horizontal axis H, each long side 25 being in the form of a convex curve having an apical part on the vertical axis V.

In a case where the long and short sides 25 and 24 for the inside profile are in the form of a convex curve, the individual corners are all formed with arc curves, i.e., arcs 22 and 26 in both inside and outside profiles so as to prevent an abrupt decrease in the thickness in the vicinity of the corners that may be caused by a difference between inner and outer diameters La and LA in the direction of the horizontal (major) axis, and a difference between inner and outer diameters Sa and SA in the direction of the minor axis.

The long and short sides perpendicular to the tubular axis Z with respect to the inside profile of the yoke mounting part 12 have such a thickness as determined based on the profile of an electron beam passage region 23 in the yoke mounting part 12.

Therefore, as described above, the cross section of the yoke mounting part 12 has an inside profile formed with convex curves in the form of a pincushion approximate to the electron beam passage region 23, thereby converging the inside of the yoke mounting part 12 on the electron beam passage region 23. For example, a gap between the inside of the yoke mounting part 12 and the electron beam passage region 23 is approximately 1 mm.

The cross section of the yoke mounting part 12 of the funnel 4 has the outside profile in an approximately rectangular form, with the inside profile having the respective sides in the form of a convex curve protruding in the direction of the tubular axis Z. This approximates the inside of the yoke mounting part 12 to the electron beam passage region 23 and enhances deflection efficiency of the deflection yoke 6 to reduce deflection power consumption.

Such a pyramidal yoke mounting part 12 enables reduction of the horizontal and vertical diameters in the directions of the horizontal (major) and vertical (minor) axes H and V of the deflection yoke 6, respectively. Thus the horizontal and vertical deflecting coils of the deflection yoke 6 become closer to the electron beams 8 to efficiently deflect the electron beams 8 and reduce deflection power consumption.

The above-stated cathode-ray tube may reduce deflection power consumption simply by decreasing the diameter of the neck 7 or the outer diameters of the yoke mounting part 12 of the funnel 4. But, as the cross section of such a yoke mounting part 12 approximates a rectangular form, deformation occurs in originally flat vicinities 100 and 101 of the horizontal and vertical axes H and V in the directions as indicated by broken lines 103 of FIG. 5 due to a load F of the atmospheric pressure. The deformation causes compressive stresses sH and sV on the outer surface of the vicinities 100 and 101 of the horizontal and vertical axes H and V of the yoke mounting part 12 and an excessive tensile stress sD on the outer surface of a vicinity 102 of the diagonal axis D, as a result of which the outer vacuum tube 10 has a deterioration of the atmospheric pressure resistance and safety.

In the aspect of this problem, Japanese Patent Pyung10-154472 discloses a yoke mounting part of the funnel 4 in the form of a pyramid that reduces the distance from the deflection yoke to the electron beams in order to prevent occurrence of a neck shadow and deterioration of atmospheric pressure resistance.

The cross section of such a yoke mounting part has inside and outside profiles with two horizontal sides opposite to each other based on the horizontal axis interposed between them in the form of a straight line and two vertical sides opposite to each other based on the vertical axis between them in the form of a convex curve protruding in the direction of the tubular axis, so that the atmospheric pressure resistance and the margin of BSN are secured due to the difference in the thickness between the long or short sides and the corners.

However, with an excessive difference in the thickness between the long or short sides and the corners in order to secure the margin of BSN, the pyramidal cathode-ray tube according to Japanese Patent Pyung10-154472 may have an increase in the maximum vacuum strength (tensile strength) on the corners of the funnel to cause explosion of an exhaust gas in the manufacture of the cathode-ray tube and increment the distance from the deflecting coils to the electron beam passage region, thus increasing deflection power consumption. Otherwise, when the thickness difference between the long or short sides and the corners is decreased in order to prevent explosion and reduce deflection power consumption, an excessive stress occurs on the BSN and the long and short sides.

Especially, in a case of wide-angle deflection with the pyramidal funnel yoke structure, the inside profile has the form of a pincushion and the outside profile has the form of a straight line so that long sides are more deteriorated in strength than short sides.

SUMMARY OF THE INVENTION

It is, therefore, an object of the present invention to provide a cathode-ray tube that minimizes the atmospheric pressure stress imposed on the funnel, in which a yoke mounting part has inside and outside profiles uniform in thickness along the horizontal (major) and vertical (minor) axes according to the deflection angle of electron beams with respect to a diagonal axis of the yoke mounting part, with the long and short sides having a different thickness from each other, thereby enhancing the strength of a weak portion.

It is another object of the present invention to provide a cathode-ray tube that secures the margin of neck shadow and the atmospheric pressure resistance of the funnel, in which a yoke mounting part has inside and outside profiles uniform in radius along the horizontal (major) and vertical (minor) axis according to the deflection angle of electron beams with respect to a diagonal axis of the yoke mounting part, thus optimizing the thickness ratio according to the position based on the length of each axis.

It is further another object of the present invention to provide a cathode-ray tube that minimizes the atmospheric pressure stress imposed on the funnel and enhance deflection sensitivity, in which a yoke mounting part divided into equal "n" parts has an optimized ratio of the diagonal thickness to the horizontal or vertical thickness perpendicular to the tubular axis per a regular interval at each position.

It is still further another object of the present invention to provide a cathode-ray tube that secures the margin of neck shadow and minimizes deflection power consumption, in which a yoke mounting part has a ratio of the diagonal radius of inner curvature to the diagonal radius of outer curvature in an appropriate range, thus approaching the magnetic fields of the deflecting coils to the electron beams based on the deflection angle of the electron beams as much as possible.

To achieve the above objects of the present invention, in a cathode-ray tube which has a panel provided with a fluorescent screen on an inner surface thereof, a funnel joined to the panel, a neck joined to the funnel and provided with electron guns facing the fluorescent screen, and a pyramidal yoke mounting part provided in a region extending from the neck side to the panel side, the yoke mounting part is defined to extend from a joint with the neck to at least the end of a deflection yoke on the side of the screen and includes: an inside profile having a form protruding towards a tubular axis in the direction of major and minor axes based on a diagonal axis so as to have a functional relation with a deflection angle; and an outside profile having an approximately rectangular form with respect to the major and minor axes. The outside profile has a ratio of maximum thicknesses in the direction of the minor and major axes in the range from 1.0 to 1.2.

In another aspect of the present invention, there is provided a cathode-ray tube which has a panel provided with a fluorescent screen on an inner surface thereof, a funnel joined to the panel, a neck joined to the funnel and provided with electron guns facing the fluorescent screen, and a pyramidal yoke mounting part provided in a region extending from the neck side to the panel side, the yoke mounting part being defined to extend from a joint with the neck to at least the end of a deflection yoke on the side of the screen, the yoke mounting part including: an inside profile having a form protruding towards a tubular axis in the direction of major and minor axes based on a diagonal axis so as to have a functional relation with a deflection angle; and an outside profile having a rectangular form with respect to the major and minor axes, the outside profile having a ratio of a maximum thickness to a minimum thickness on the same axis being either of the minor or major axis in the range from 1.0 to 1.5.

In further another aspect of the present invention, there is provided a cathode-ray tube which has a panel provided with a fluorescent screen on an inner surface thereof, a funnel joined to the panel, a neck joined to the funnel and provided with electron guns facing the fluorescent screen, and a pyramidal yoke mounting part provided in a region extending from the neck side to the panel side, the yoke mounting part being defined to extend from a joint with the neck to at least the end of a deflection yoke on the side of the screen; and when a tubular axis ranging from the joint with the neck to the end of the deflection yoke is divided into equal "n" parts, a value of Td/Tv or Td/Th being in the range from 0.5 to 0.85, wherein Tv, Th and Td are thicknesses in the directions of minor, major and the diagonal axes, respectively, perpendicular to the tubular axis at each length-based position.

In still further another aspect of the present invention, there is provided a cathode-ray tube, which has a panel provided with a fluorescent screen on an inner surface thereof, a funnel joined to the panel, a neck joined to the funnel and provided with electron guns facing the fluorescent screen, and a pyramidal yoke mounting part provided in a region extending from the neck side to the panel side, the yoke mounting part being defined to extend from a joint with the neck to at least the end of a deflection yoke on the side of the screen. When a tubular axis ranging from the joint with the neck to the end of the deflection yoke is divided into equal "n" parts, it satisfies $0.5 \leqq Td/Tv \leqq 0.85$ and $0.5 \leqq Td/Th \leqq 0.85$, wherein Tv, Th and Td are thicknesses in the directions of minor, major and the diagonal axes, respectively, perpendicular to the tubular axis at each length-based position; and $0.35 \leqq Rid/Rod \leqq 0.67$, wherein Riv and Rov are radii of inner and outer curvatures in the direction of the minor axis perpendicular to the tubular axis, respectively; Rih and Roh are radii of inner and outer curvatures in the direction of the major axis perpendicular to the tubular axis, respectively; Rid is a radius of inner curvature at a corner approximating Riv and Rih; and Rod is a radius of outer curvature at the corner approximating Rov and Roh.

BRIEF DESCRIPTION OF THE DRAWINGS

FIGS. 1 to 5 are diagrams illustrating a color cathode-ray tube in accordance with prior art, wherein FIG. 1 is a perspective of the color cathode-ray tube viewed from the backside, FIG. 2 is a cross-sectional view taken along the tubular axis of the color cathode-ray tube, FIG. 3 is a cross-sectional view taken along the line I—I of FIG. 1, FIG. 4 is a cross-sectional view taken along the line II—II of FIG. 1, and FIG. 5 is a diagram for explaining stresses occurring in the yoke mounting part of FIG. 1;

FIGS. 6 to 10 are diagrams of a color cathode-ray tube in accordance with an embodiment of the present invention, wherein FIG. 6 is a perspective of the color cathode-ray tube viewed from the backside, FIG. 7 is a cross-sectional view taken along the line III—III of FIG. 6, FIG. 8 is a cross-sectional view taken along the line IV—IV of FIG. 6, FIG. 9 is a schematic view showing the cross section of a quarter side of FIG. 7 for explaining inside and outside profiles of the yoke mounting part of FIG. 6, and FIG. 10 is a cross-sectional view taken along the line VI—VI of FIG. 6, illustrating the upper half of the cathode-ray tube above a tubular axis;

FIG. 11 is a cross-sectional view of a cathode-ray tube in accordance with another embodiment of the present invention, for explaining inside and outside profiles of the yoke mounting part of FIG. 6; and FIGS. 12 and 13 are diagrams of a cathode-ray tube in accordance with further another embodiment of the present invention, wherein FIG. 12 is a cross-sectional view taken along the line III—III of FIG. 6, and FIG. 13 is a cross-sectional view taken along the line IV—IV of FIG. 6.

DETAILED DESCRIPTION OF PREFERRED EMBODIMENTS

Figure 1:
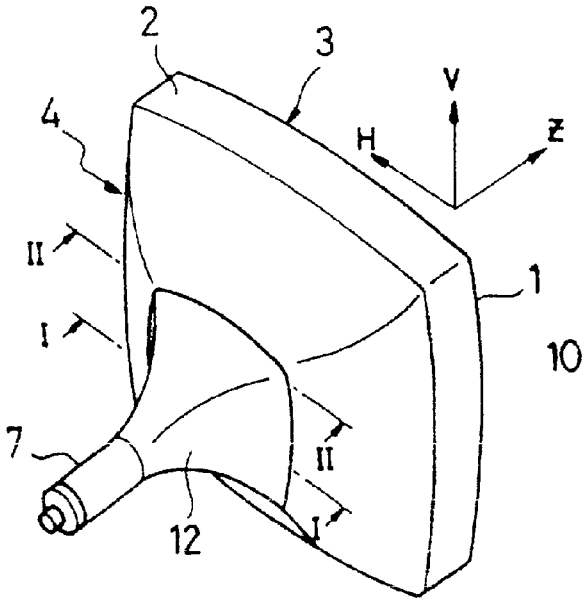
Fig. 1 PRIOR ART
Figure 2:
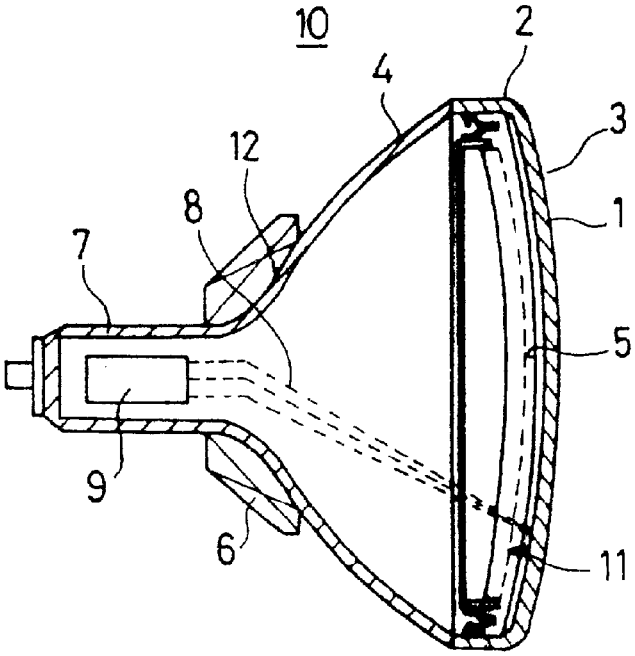
Fig. 2 PRIOR ART
Figure 3:
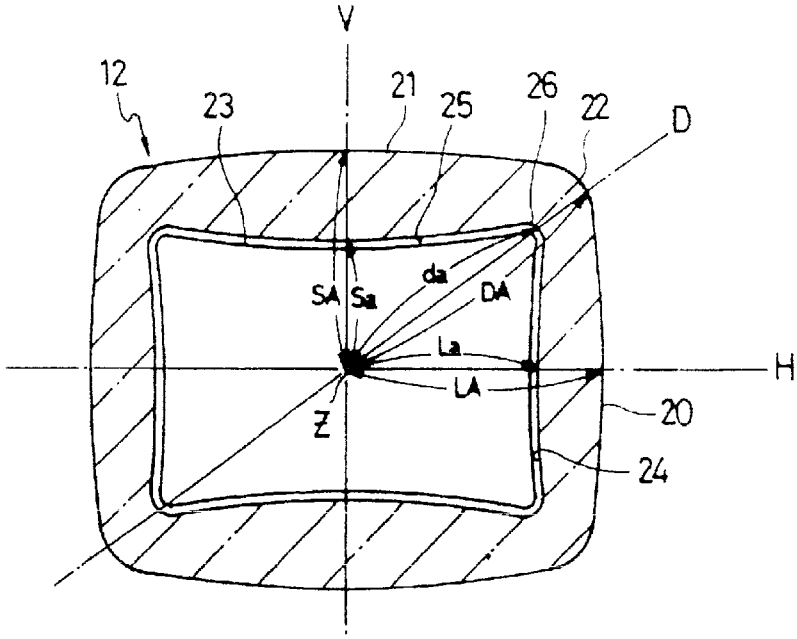
Fig. 3 PRIOR ART
Figure 4:
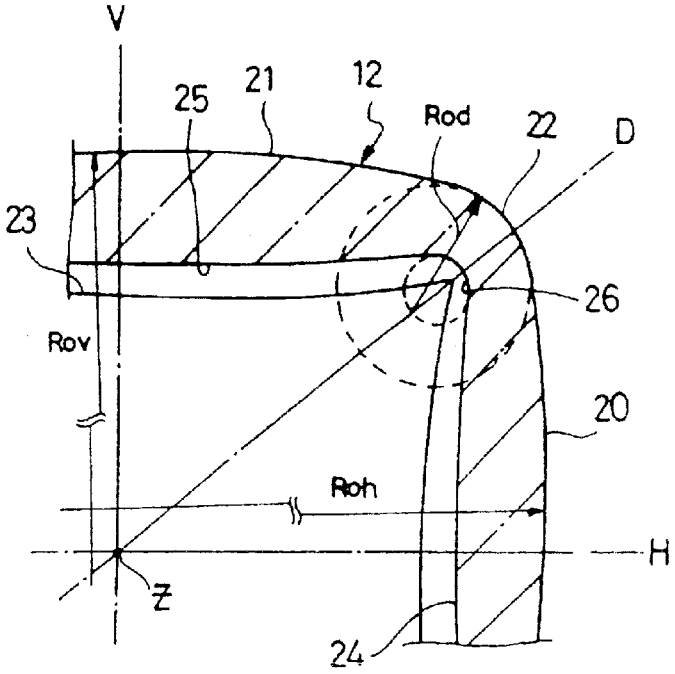
Fig. 4 PRIOR ART
Figure 5:
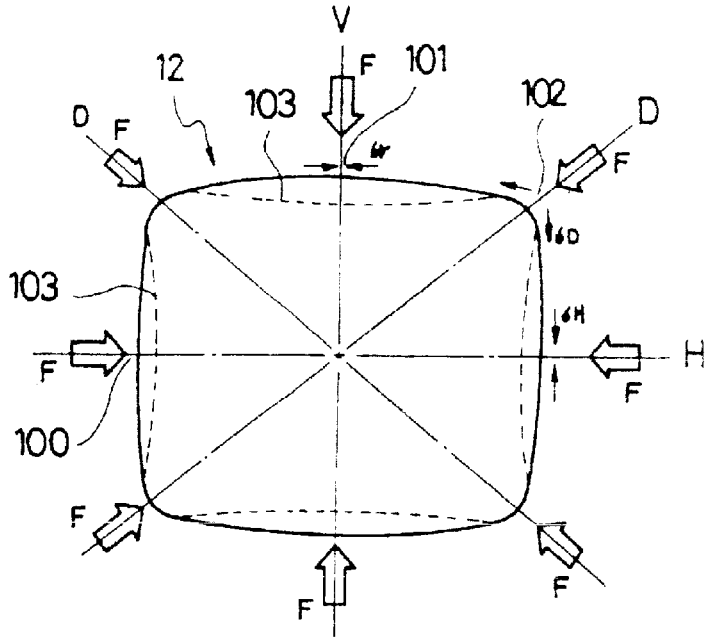
Fig. 5 PRIOR ART

Hereinafter, preferred embodiments of a cathode-ray tube according to the present invention will be described in detail with reference to the attached drawings.

It is to be noted that like reference numerals denote the same components in the drawings, and a detailed description of generally known function and structure of the present invention will be avoided lest it should obscure the subject matter of the present invention.

Figure 6:
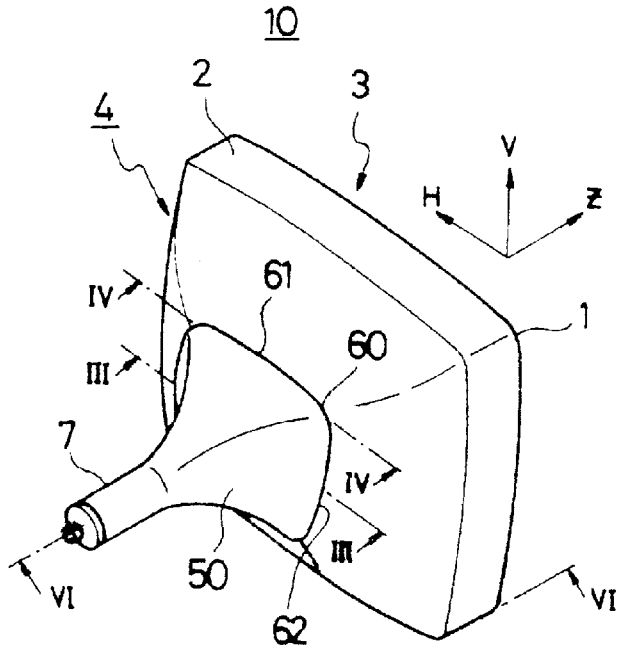

FIG. 6 is a perspective view illustrating a color cathode-ray tube of the present invention viewed from the backside, FIG. 7 a cross-sectional view taken along the line III—III of FIG. 6, FIG. 8 a cross-sectional view taken along the line IV—IV of FIG. 6.

The color cathode-ray tube of the present invention has an outer vacuum tube 10 made of glass.

The outer vacuum tube 10 comprises a face panel 3 having an approximately rectangular effective part 1 and a skirt part 2 provided in the periphery of the effective part 1, a funnel 4 joined to the skirt part 2, and a cylindrical neck 7 extending from the funnel 4.

The effective part 1 of the face panel 3 has an approximately rectangular form with horizontal and vertical axes H and V perpendicular to each other through a tubular axis Z of the cathode-ray tube.

The funnel 4 has a small-diameter region, so-called yoke mounting part 50 extending from the joint with the neck 7 to the mount position of a deflection yoke 6, i.e., extending to the side of the face panel 3.

Especially, the yoke mounting part 50 of the funnel 4 in which the deflection yoke 6 is mounted in the color cathode-ray tube has an approximately pyramidal shape.

More specially, the pyramidal yoke mounting part 50 has a circular cross section perpendicular to the tubular axis Z around the joint with the neck 7 and an approximately rectangular cross section in conformity with the profile of the effective part 1 of the face panel 3, as shown in FIG. 8, around the central portion along the tubular axis Z and the end portion on the side of a fluorescent screen 5.

As illustrated in FIG. 8, the cross section of the yoke mounting part 12 has an outside profile in an approximately rectangular form constituted by the continuity of a pair of circular arcs 51 for a horizontal radius of curvature Roh having a center on the horizontal axis H, a pair of circular arcs 52 for a vertical radius of curvature Rov having a center on the vertical axis V, and a pair of circular arcs 53 for a diagonal radius of curvature Rod having a center on the diagonal axis D.

As illustrated in FIG. 10, the deflection yoke 6 is mounted to have an end 59 on the side of the panel 3 be located in the vicinity of a diagonal inflection point 60 and the pyramidal yoke mounting part 50 substantially extends at least to a joint 58 with the neck 7.

The cross section of the yoke mounting part 50 has, as shown in FIGS. 6 and 7, an inside profile in which a long side inflection point 61, a short side inflection point 62 and the diagonal inflection point 60 have the same position on the horizontal, vertical and diagonal axes H, V and D with respect to the coordinates in the direction of the tubular axis Z. Thus the inside profile has inner diameters Lap, Sap and dap in the directions of the horizontal (major), vertical (minor) and diagonal axes H, V and D, respectively, extending from the joint 58 with the neck 7 to the end 59 of the deflection yoke 6.

The outside profile of the yoke mounting part 50 has an outer diameter DAP in the direction of the diagonal axis D, an outer diameter LAP in the direction of the horizontal (major) axis H larger than Lap, and an outer diameter SAP in the direction of the vertical (minor) axis V larger than Sap, extending from the joint 58 with the neck 7 to the end 59 of the deflection yoke 6.

As illustrated in FIGS. 9 and 10, the yoke mounting part 50 has a thickness Th representing a difference between inner and outer diameters Lap and LAP in the direction of the horizontal (major) axis H, and a thickness Tv representing a difference between inner and outer diameters Sap and SAP in the direction of the vertical (minor) axis V, in the cross section taken along the tubular axis Z approximately corresponding to the deflection center, referred to as a deflection baseline 57.

The maximum vacuum stress, which refers to the maximum stress imposed on the entire region of the yoke mounting part 50, occurs in the tensile direction at the respective corners of the pyramidal yoke mounting part 50 slightly towards the side of the fluorescent screen 5 rather than the deflection baseline 57.

As such, the yoke mounting part 50 has the inside profile not in a perfect plane but in the form of a pincushion protruding along the tubular axis Z, as illustrated in FIGS. 7 and 8. The inside profile has long sides with a thickness representing a difference between inner and outer diameters Lap and LAP, and short sides with a thickness representing a difference between inner and outer diameters Sap and SAP. That is, the cross section perpendicular to the tubular axis Z of the yoke mounting part 50 has the inside profile not in a perfect rectangular form but in an imperfect rectangular form of which the respective sides are formed of a convex curve protruding along the tubular axis Z with inner diameters Lap and Sap along the major and minor axes, respectively.

Each short side 54 of the inside profile of the yoke mounting part 50 is formed with a convex curve having an apical part on the horizontal axis H, each long side 55 being formed with a convex curve having an apical part on the vertical axis V.

In a case where the long and short sides 55 and 54 of the inside profile are formed with convex curves, the individual corners are all formed with arc curves, i.e., arcs 53 and 56 in both inside and outside profiles due to an increase in a horizontal thickness representing a difference between inner and outer diameters Lap and LAP along the horizontal axis H and a vertical thickness representing a difference between inner and outer diameters Sap and SAP along the vertical axis V. Thus the inside profile of the yoke mounting part 50 approaches the electron beam passage region to secure a sufficient internal space.

The cross section of the yoke mounting part 50 has, as shown in FIG. 8, thicknesses Tv and Th along the vertical (minor) and horizontal (major) axes perpendicular to the tubular axis Z, a vertical radius of outer curvature Rov, a horizontal radius of outer curvature Roh, and a diagonal radius of outer curvature Rod approximating the horizontal and vertical radii Roh and Rov. The yoke mounting part 50 has to be designed to approach the inside profile of the funnel 4 to the trajectory of electron beams at a fixed length of the corners along the beam trajectory, and the outside profile of the funnel 4 to the deflecting coils of the deflection yoke 6 as possible. Then, the yoke mounting part 50 usually has a larger thickness in the center than in the vicinity of the corners.

In a case where the vertical thickness has a large difference from the horizontal thickness, the horizontal and vertical radii of outer curvature Roh and Rov are decreased to protrude the outside profile of the yoke mounting part 50 outwardly, enhancing pressure resistance, and the deflection coil is more separated from the electron beams 8 at a large distance, which increases deflection power consumption and deteriorates the BSN. Otherwise, when the vertical thickness has a small difference from the horizontal thickness, the horizontal and vertical radii of outer curvature Roh and Rov are increased to have the outside profile of the yoke mounting part 50 relatively plane, and the deflection coil is less separated from the electron beams 8 at a small distance, resulting in a decrease in the deflection power consumption with enhanced BSN, but reducing the resistance to tensile stress. Especially, with a small difference between horizontal and vertical thicknesses, tensile stress intensifies along the horizontal (major) axis H.

In accordance with an example of experiments performed by the inventor of the present invention, the yoke mounting part 50 has an inside profile in a pincushion form protruding towards the tubular axis Z along the horizontal (major) and vertical (minor) axes H and V based on the diagonal axis D to have a functional relation with a deflection angle, and an outside profile in an approximately rectangular form with respect to the horizontal (major) and vertical (minor) axes H and V. In the experiment, an optimal tensile stress occurs when it satisfies $1.0<Tvc/Thc\leqq 1.2$, wherein Tvc and Thc are maximum thicknesses along the vertical (minor) and horizontal (major) axes V and H, respectively, perpendicular to the tubular axis Z. Here, the yoke mounting part 50 having a ratio of the maximum vertical thickness Tvc to the maximum horizontal thickness Thc extends from the deflection baseline 57 to the inflection point 60 along the tubular axis Z.

In another example of experiments in the present invention, the atmospheric pressure resistance and the BSN margin can be enhanced by controlling a horizontal thickness Th with a fixed vertical thickness Tv perpendicular to the tubular axis Z in the cross section of the yoke mounting part 50 with the above-structured inside and outside profiles.

That is, an optimal tensile stress occurs when it satisfies $1.0<Thc/Thc1\leqq 1.5$ and $0.7<Rov/Roh\leqq 1.0$, wherein Thc is the maximum horizontal thickness, Thc1 is the minimum horizontal thickness, Roh is the horizontal radius of outer curvature, and Rov is the vertical radius of outer curvature.

In another embodiment of the present invention, as shown in FIG. 11, the cross section of the yoke mounting part 50 has an outside profile in a barrel form at least with respect to the one axis and in a perfect rectangular form with respect to the other axis.

Namely, the outside profile of the yoke mounting part 50 has two long sides opposite to each other based on the horizontal axis H in a barrel form outwardly protruding with respect to the tubular axis Z, and two short sides opposite to each other based on the vertical axis V in a straight line form with respect to the tubular axis Z, satisfying $1.0<Thc/Thc1\leqq 1.5$ to secure sufficient atmospheric pressure resistance and BSN margin.

In summary, in designing the yoke mounting part 50 to have an inside profile in a pincushion form protruding towards the tubular axis Z along the horizontal (major) and vertical (minor) axes H and V based on the diagonal axis D, thus having a functional relation with a deflection angle, and an outside profile in an approximately rectangular form along the horizontal and vertical axes H and V, the BSN margin of the inside profile of the funnel and the pressure resistance of the funnel according to wide-angle deflection can be enhanced at the ratio of the maximum vertical thickness to the maximum horizontal thickness in the range from 1.0 to 1.2 (i.e., $1.0<Tvc/Thc\leqq 1.2$), as in the former experiment of the present invention; or at the ratio of the maximum horizontal thickness to the minimum horizontal thickness in the range from 1.0 to 1.5 (i.e., $1.0<Thc/Thc1\leqq 1.5$) and the ratio of the vertical radius of outer curvature to the horizontal radius of outer curvature ranging from 0.7 to 1.0 (i.e, $0.7<Rov/Roh\leqq 1.0$), as in the latter experiment of the present invention.

In contrast to the prior art where the cross section of the yoke mounting part perpendicular to the tubular axis has inside and outside profiles formed with convex curves in order to secure sufficient atmospheric pressure resistance and BSN margin, the present invention designs the pyramidal yoke mounting part having a cross section optimized in the ratio of the vertical thickness to the horizontal thickness perpendicular to the tubular axis, the ratio of the maximum thickness to the minimum thickness on the same axis, and in the radii of curvature, thereby securing the BSN margin at the corners of the yoke mounting part, minimizing compressive stress imposed on the horizontal (major) axis and decreasing a distance from the electron beams to the magnetic field to reduce deflection power consumption.

FIGS. 12 and 13 are diagrams of a color cathode-ray tube in accordance with further another embodiment of the present invention, wherein FIG. 12 is a cross-sectional view taken along the line III—III of FIG. 6 and FIG. 13 is a cross-sectional view taken along the line IV—IV of FIG. 6.

The color cathode-ray tube of this embodiment has an outer vacuum tube 10 made of glass.

The outer vacuum tube 10 comprises a face panel 3 having an approximately rectangular effective part 1 and a skirt part 2 provided in the periphery of the effective part 1, a funnel 4 joined to the skirt part 2, and a cylindrical neck 7 extending from the funnel 4.

The effective part 1 of the face panel 3 has an approximately rectangular form with horizontal and vertical axes H and V perpendicular to each other through a tubular axis Z of the cathode-ray tube.

The funnel 4 has a small-diameter region, so-called yoke mounting part 50 extending from the joint with the neck 7 to the mount position of a deflection yoke 6, i.e., extending to the side of the face panel 3.

Especially, the yoke mounting part 50 of the funnel 4 in which the deflection yoke 6 is mounted in the color cathode-ray tube has an approximately pyramidal shape.

More specially, the pyramidal yoke mounting part 50 has a circular cross section perpendicular to the tubular axis Z as the neck 7 around the joint with the neck 7 and an approximately rectangular cross section in conformity with the profile of the effective part 1 of the face panel 3, as shown in FIG. 13, around the central portion along the tubular axis Z and the end portion on the side of a fluorescent screen 5.

As illustrated in FIG. 13, the cross section of the yoke mounting part 50 has an outside profile in an approximately rectangular form constituted by the continuity of a pair of circular arcs 51 for a horizontal radius of curvature Roh having a center on the horizontal (major) axis H of the effective part 1, a pair of circular arcs 52 for a vertical radius of curvature Rov having a center on the vertical axis V, and a pair of circular arcs 53 for a diagonal radius of curvature Rod having a center on the diagonal axis D.

The cross section of the yoke mounting part 50 has, as shown in FIGS. 12 and 13, an inside profile in which a long side inflection point 61, a short side inflection point 62 and a diagonal inflection point 60 have a different position on the horizontal (major), vertical (minor) and diagonal axes H, V and D with respect to the coordinates along the tubular axis Z, so that the inside profile has inner diameters Lap, Sap and dap along the horizontal (major), vertical (minor) and diagonal axes H, V and D, respectively, extending from the joint with the neck 7 to the end of the deflection yoke 6.

The outside profile of the yoke mounting part 50 has an outer diameter DAP along the diagonal axis D, an outer diameter LAP along the horizontal (major) axis H larger than Lap, and an outer diameter SAP along the vertical (minor) axis V larger than Sap, extending from the joint with the neck 7 to the end of the deflection yoke 6.

As illustrated in FIGS. 13, the yoke mounting part 50 has a thickness Th representing a difference between inner and outer diameters Lap and LAP along the horizontal (major) axis H, a thickness Tv representing a difference between inner and outer diameters Sap and SAP along the vertical (minor) axis V, and a thickness Td representing a difference between inner and outer diameters dap and DAP along the diagonal axis D, in the cross section taken along the tubular axis Z approximately corresponding to the deflection center, referred to as a deflection baseline.

The maximum vacuum stress, which refers to the maximum stress imposed on the entire region of the yoke mounting part 50, occurs in the tensile direction at the respective corners of the pyramidal yoke mounting part 50 slightly towards the side of the fluorescent screen 5 rather than the deflection baseline 57.

As such, the yoke mounting part 50 has an inside profile not in a perfect plane form but in an approximately rectangular form slightly protruding along the tubular axis Z, as illustrated in FIGS. 12 and 13. That is, the cross section perpendicular to the tubular axis Z of the yoke mounting part 50 has the inside profile not in a perfect rectangular form but in an imperfect rectangular form of which the respective sides are formed of a convex curve gently protruding in the direction of the tubular axis Z with inner diameters Lap and Sap along the horizontal (major) and vertical (minor) axes H and V, respectively.

As shown in FIG. 13, short sides 54 of the inside profile of the yoke mounting part 50 are formed with a pair of convex curves having a radius of curvature Rih and a gentle apical part on the horizontal axis H, long sides 55 being formed with a pair of convex curves having a radius of curvature Riv and a gentle apical part on the vertical axis V, a diagonal side 56 being formed with a circular arc having a radius of curvature Rid and a center on the diagonal axis D.

In a case where the long and short sides 55 and 54 of the inside profile are formed with convex curves, the individual corners are all formed of arc curves, i.e., arcs 53 and 56 in both inside and outside profiles due to an increase in a horizontal thickness representing a difference between inner and outer diameters Lap and LAP along the horizontal (major) axis H, a vertical thickness representing a difference between inner and outer diameters Sap and SAP along the vertical (minor) axis V, and a diagonal thickness representing a difference between inner and outer diameters dap and DAP along the diagonal axis D. Thus the inside profile of the yoke mounting part 50 approaches the electron beam passage region to secure a sufficient internal space.

The cross section of the yoke mounting part 50 has, as shown in FIG. 13, thicknesses Tv, Th and Td along vertical (minor), horizontal (major) and diagonal axes V, H and D, respectively, perpendicular to the tubular axis Z, vertical radii of inner and outer curvatures Riv and Rov, horizontal radii of inner and outer curvatures Rih and Roh, and diagonal radii of inner and outer curvatures Rid and Rod approximating Riv and Rih. The yoke mounting part 50 has to be designed to approach the inside profile of the funnel 4 to the trajectory of electron beams at a fixed length of the corners along the beam trajectory, and the outside profile of the funnel 5 to the deflecting coil of the deflection yoke 6 as possible. Therefore, the yoke mounting part 50 has a larger thickness in the center than in the vicinity of the corners.

However, in a case where the vertical thickness Tv at the center has an extremely large difference from the diagonal thickness Td at the corners, the vertical radii of inner and outer curvatures Riv and Rov are decreased to outwardly protrude the outside profile of the yoke mounting part 50 of the funnel 4 and separate the deflection coil from the electron beams 8 at the larger distance, which increases deflection power consumption. Otherwise, when reducing a difference between the vertical thickness Tv and the diagonal thickness Td, the vertical radii of inner and outer curvatures Riv and Rov are increased to have the outside profile of the yoke mounting part 50 of the funnel 4 relatively plane, and the deflection coil is less separated from the electron beams 8 at a small distance, thus reducing deflection power consumption.

A decrease in the ratio of the diagonal thickness Td to the vertical or horizontal thickness Tv or Th lowers resistance to tensile stress, and an extreme increase in the ratio Td/Tv (or Th) deteriorates deflection sensitivity.

In accordance with an example of experiments performed by the inventor of the present invention, an optimal tensile stress occurs with reduced deflection power consumption when it satisfies $0.5 \leqq Td/Tv \leqq 0.85$, and $0.5 \leqq Td/Th \leqq 0.85$, wherein Tv, Th and Td are vertical, horizontal and diagonal thicknesses perpendicular to the tubular axis Z, respectively. Especially, sufficient deflection sensitivity, atmospheric pressure resistance and BSN margin can be secured when it satisfies $0.3 \leqq Td_L/Tv_L \leqq 0.6$, wherein $Tv_L$ and $Td_L$ are vertical and diagonal thicknesses perpendicular to the tubular axis Z in the vicinity of the deflection base position, respectively, and when it satisfies $Tdt/Tvt \leqq Td_L/Tv_L$ and $Tdt/Tht \leqq Td_L/Th_L$, wherein Tvt, Tdt and Tht are vertical, diagonal and horizontal thicknesses at the inflection points of the yoke part and the funnel part, respectively; and $Th_L$, $Tv_L$ and $Td_L$ are horizontal, vertical and diagonal thicknesses at the deflection base position, respectively.

In another example of the experiments in the present invention, good deflection sensitivity, atmospheric pressure resistance and BSN margin can be secured when it satisfies $0.35 \leqq Rid/Rod \leqq 0.67$, wherein Rid and Rod are diagonal radii of inner and outer curvatures, respectively, approximating Riv and Rov, and Rih and Roh.

The optimal BSN and good pressure resistance of the funnel 4 can also be secured with effective reduction of deflection power consumption when the ratio of the diagonal radius of inner curvature Rid to the diagonal radius of outer curvature Rod has a value in the range from 0.35 to 0.5 (i.e., $0.35 \leqq Rid/Rod \leqq 0.5$).

In summary, in designing the yoke mounting part 40 and dividing the tubular axis Z extending from the joint with the neck 7 to the end portion on the side of the deflection yoke 6 into equal "n" parts, the BSN margin of the inside profile of the funnel 4 and the pressure resistance of the funnel 4 according to wide-angle deflection can be enhanced when the ratio of the diagonal thickness to the vertical or horizontal thickness perpendicular to the tubular axis Z at the respective positions is in the range from 0.5 to 0.85 (i.e., $0.5 \leqq Td/Tv \leqq 0.85$, or $0.5 \leqq Td/Th \leqq 0.85$); the ratio of the diagonal radii of inner curvature to the diagonal radii of outer curvature is in the range from 0.35 to 0.67, or from 0.35 to 0.5 (i.e., $0.35 \leqq Rid/Rod \leqq 0.67$, or $0.35 \leqq Rid/Rod \leqq 0.5$); and the ratio of the diagonal thickness to the vertical thickness in the vicinity of the deflection base position is in the range from 0.3 to 0.6 (i.e., $0.3 \leqq Td_L/Tv_L \leqq 0.6$).

In contrast to the prior art where a portion of the corners of the yoke mounting part on the side of the funnel is sectioned to prevent collision with electron beams and the ratio of the diagonal thickness on the corners to the horizontal or vertical thickness on the long or short sides is increased to prevent explosion and reduce deflection power consumption, the present invention designs the pyramidal yoke mounting part to have a cross section optimized in the horizontal, vertical and diagonal thicknesses perpendicular to the tubular axis, and the radii of inner and outer curvatures, thus securing the BSN margin at the corners of the yoke mounting part, minimizing compressive stress and decreasing a distance between the electron beams and the magnetic field of the deflection yoke to reduce deflection power consumption.

As describe above, the wide-angle deflecting cathode-ray tube of the present invention has a pyramidal yoke mounting part designed to optimize the ratio of thickness on the major and minor axes, the ratio of thickness on the same axis and the curvature, which enhances the neck shadow (BSN) in the inner surface of the funnel according to wide-angle deflection and the atmospheric pressure resistance of the funnel. Furthermore, the pyramidal yoke mounting part has an inside profile projecting in the direction of the tubular axis to approach the electron beams to the maximum, so that a degree of freedom increases in designing the outside profile of the funnel.

Also, the wide-angle deflecting cathode-ray tube of the present invention has a pyramidal yoke mounting part designed to optimize the ratio of thickness in the directions of minor, major and diagonal axes and the range of inner and outer curvatures joined to the corners, thus securing the margin of neck shadow (BSN) on the inner surface of the funnel according to wide-angle deflection, enhancing atmospheric pressure resistance of the funnel, and reducing deflection power consumption, without a deterioration of deflection sensitivity.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. A cathode-ray tube, which has a panel provided with a fluorescent screen on an inner surface thereof, a funnel joined to the panel, a neck joined to the funnel and provided with electron guns facing the fluorescent screen, and a pyramidal yoke mounting part provided in a region extending from the neck side to the panel side, the yoke mounting part being defined to extend from a joint with the neck to at least the end of a deflection yoke on the side of the screen, the yoke mounting part comprising:

an inside profile having a form protruding towards a tubular axis in the direction of major and minor axes based on a diagonal axis so as to have a functional relation with a deflection angle; and an outside profile having an approximately rectangular form with respect to the major and minor axes, the outside profile having a ratio of maximum thicknesses Tvc/Thc in the directions of the minor and major axes in the range from >1.0 to ≦1.2, where Thc and Tvc are maximum thicknesses in the directions of the major and minor axes, respectively.

2. The cathode-ray tube as claimed in claim 1, wherein the ratio of the maximum thickness in the direction of the minor axis to the maximum thickness in the direction of the major axis is in the range from 1.0 to 1.2.

3. A cathode-ray tube, which has a panel provided with a fluorescent screen on an inner surface thereof, a funnel joined to the panel, a neck joined to the funnel and provided with electron guns facing the fluorescent screen, and a pyramidal yoke mounting part provided in a region extending from the neck side to the panel side, the yoke mounting part being defined to extend from a joint with the neck to at least the end of a deflection yoke on the side of the screen, the yoke mounting part comprising:

an inside profile having a form protruding towards a tubular axis in the direction of major and minor axes based on a diagonal axis so as to have a functional relation with a deflection angle; and an outside profile having an approximately rectangular form with respect to the major and minor axes, the outside profile having a ratio of maximum thicknesses in the directions of the minor and major axes in the range from 1.0 to 1.2, wherein when the length of the yoke mounting part is divided into equal "n" parts in the directions of the minor and major axes, it satisfies a relation $1.0<Tv/Th\leqq 1.2$, wherein Th and Tv are thicknesses in the directions of the major and minor axes, respectively, at each length-based position.

4. The cathode-ray tube as claimed in claim 3, wherein the yoke mounting part having the ratio of the thickness in the direction of the minor axis to the thickness in the direction of the major axis extends from a deflection baseline to an inflection point with respect to the tubular axis.

5. A cathode-ray tube, which has a panel provided with a fluorescent screen on an inner surface thereof, a funnel joined to the panel, a neck joined to the funnel and provided with electron guns facing the fluorescent screen, and a pyramidal yoke mounting part provided in a region extending from the neck side to the panel side, the yoke mounting part being defined to extend from a joint with the neck to at least the end of a deflection yoke on the side of the screen, the yoke mounting part comprising:

an inside profile having a form protruding towards a tubular axis in the direction of major and minor axes based on a diagonal axis so as to have a functional relation with a deflection angle; and an outside profile having a rectangular form with respect to the major and minor axes, the outside profile having a ratio of a maximum thickness to a minimum thickness on the same axis being either of the minor or major axis in the range from 1.0 to 1.5.

6. The cathode-ray tube as claimed in claim 5, wherein the same axis is the major axis perpendicular to the tubular axis.

7. The cathode-ray tube as claimed in claim 6, wherein the yoke mounting part having the ratio of the maximum thickness to the minimum thickness on the major axis extends from a deflection baseline to an inflection point with respect to the tubular axis.

8. The cathode-ray tube as claimed in claim 5, wherein it satisfies a relation $0.7<Rov/Roh\leqq 1.0$, wherein Roh is a radius of outer curvature in the direction of the major axis and Rov is a radius of outer curvature in the direction of the minor axis.

9. The cathode-ray tube as claimed in claim 5, wherein the outside profile has a barrel form protruding outwardly with respect to at least one axis.

10. The cathode-ray tube as claimed in claim 9, wherein the at least one axis is the major axis perpendicular to the tubular axis.

11. A cathode-ray tube, which has a panel provided with a fluorescent screen on an inner surface thereof, a funnel joined to the panel, a neck joined to the funnel and provided with electron guns facing the fluorescent screen, and a pyramidal yoke mounting part provided in a region extending from the neck side to the panel side, the yoke mounting part being defined to extend from a joint with the neck to at least the end of a deflection yoke on the side of the screen, when a tubular axis ranging from the joint with the neck to the end of the deflection yoke is divided into equal "n" parts, a value of Td/Tv or Td/Th being in the range from 0.5 to 0.85, wherein Tv, Th and Td are thicknesses in the directions of minor, major and the diagonal axes, respectively, perpendicular to the tubular axis at each length-based position.

12. The cathode-ray tube as claimed in claim 11, wherein it satisfies a relation $0.35 \leqq Rid/Rod \leqq 0.67$, wherein Riv and Rov are radii of inner and outer curvatures in the direction of the minor axis perpendicular to the tubular axis, respectively; Rib and Roh are radii of inner and outer curvatures in the direction of the major axis perpendicular to the tubular axis, respectively; and Rid and Rod are radii of inner and outer curvatures on corners approximating Riv and Rih, and Rov and Roh, respectively.

13. The cathode-ray tube as claimed in claim 12, wherein a value of Rid/Rod is in the range from 0.35 to 0.5.

14. The cathode-ray tube as claimed in claim 11, wherein it satisfies a relation $0.3 \leqq Td_L/Tv_L \leqq 0.6$, wherein $Tv_L$ is a thickness in the direction of the minor axis perpendicular to the tubular axis and $Td_L$ is a thickness in the direction of the diagonal axis perpendicular to the tubular axis, in the vicinity of a deflection base position.

15. The cathode-ray tube as claimed in claim 14, wherein it satisfies a relation $Tdt/Tvt \geqq Td_L/Tv_L$ and $Tdt/Tht \geqq Td_L/Th_L$, wherein Tvt, Tdt and Tht are vertical, diagonal and horizontal thicknesses at inflection points of the yoke mounting part and the funnel, respectively; and $Th_L$, $Tv_L$ and $Td_L$ are horizontal, vertical and diagonal thicknesses at the deflection base position, respectively.

16. A cathode-ray tube, which has a panel provided with a fluorescent screen on an inner surface thereof, a funnel joined to the panel, a neck joined to the funnel and provided with electron guns facing the fluorescent screen, and a pyramidal yoke mounting part provided in a region extending from the neck side to the panel side, the yoke mounting part being defined to extend from a joint with the neck to at least the end of a deflection yoke on the side of the screen, when a tubular axis ranging from the joint with the neck to the end of the deflection yoke is divided into equal "n" parts, $0.5 \leqq Td/Tv \leqq 0.85$ and $0.5 \leqq Td/Th \leqq 0.85$, wherein Tv, Th and Td are thicknesses in the directions of minor, major and the diagonal axes, respectively, perpendicular to the tubular axis at each length-based position; and $0.35 \leqq Rid/Rod \leqq 0.67$, wherein Riv and Rov are radii of inner and outer curvatures in the direction of the minor axis perpendicular to the tubular axis, respectively; Rih and Roh are radii of inner and outer curvatures in the direction of the major axis perpendicular to the tubular axis, respectively; Rid is a radius of inner curvature at a corner approximating Riv and Rih; and Rod is a radius of outer curvature at the corner approximating Rov and Roh.

17. The cathode-ray tube as claimed in claim 16, wherein it satisfies $0.35 \leqq Rid/Rod \leqq 0.5$, wherein Rid is a radius of inner curvature at the corner and Rod is a radius of outer at the corner.

18. A cathode-ray tube, comprising:

a panel having a fluorescent screen on an inner surface thereof;

a funnel joined to the panel;

a neck attached to the funnel and having electron guns facing the fluorescent screen; and a pyramidal yoke mounting part provided in a region extending from a neck side to a panel side, wherein the yoke mounting part extends from a joint with the neck to at least an end of a deflection yoke on a side of the screen, and wherein the yoke mounting part comprises:

an inside profile that protrudes towards a tubular axis in a direction of major and minor axes based on a diagonal axis so as to have a functional relation with a deflection angle; and an outside profile having an approximately rectangular form with respect to the major and minor axes, the outside profile having at least one of:

(1) a ratio of maximum thicknesses in the directions of the minor and major axes in a range from approximately 1.0 to 1.2; and (2) a ratio of a maximum thickness to a minimum thickness on the same axis being either of the minor or major axis in the range from approximately 1.0 to 1.5.

19. The cathode-ray tube as claimed in claim 18, wherein a ratio of the maximum thickness in the direction of the minor axis to the maximum thickness in the direction of the major axis is in a range from approximately 1.0 to 1.2.

20. The cathode-ray tube as claimed in claim 19, wherein, when a length of the yoke mounting part is divided into equal "n" parts in the directions of the minor and major axes, the following equation is satisfied:

$$1.0 < Tv/Th \leqq 1.2$$

wherein Th and Tv are thicknesses in the directions of the major and minor axes, respectively, at each length-based position.

21. The cathode-ray tube as claimed in claim 18, wherein the following equation is satisfied:

$$0.7 < Rov/Roh \leqq 1.0$$

wherein Roh is a radius of outer curvature in the direction of the major axis and Rov is a radius of outer curvature in the direction of the minor axis.

22. A cathode-ray tube, comprising:

a panel having a fluorescent screen on an inner surface thereof;

a funnel joined to the panel;

a neck attached to the funnel and having electron guns facing the fluorescent screen; and a pyramidal yoke mounting part provided in a region extending from a neck side to a panel side, wherein the yoke mounting part extends from a joint with the neck to at least an end of a deflection yoke on a side of the screen, and wherein, when a tubular axis ranging from the joint with the neck to the end of the deflection yoke is divided into equal "n" parts, a value of Td/Tv or Td/Th is in a range from approximately 0.5 to 0.85, wherein Tv, Th and Td are thicknesses in the directions of minor, major and the diagonal axes, respectively, perpendicular to the tubular axis at each length-based position.

23. The cathode-ray tube as claimed in claim 22, wherein, when a tubular axis ranging from the joint with the neck to the end of the deflection yoke is divided into equal "n" parts, the following equations are satisfied:

$$0.5 \leqq Td/Tv \leqq 0.85 \text{ and } 0.5 \leqq Td/Th \leqq 0.85$$

wherein Tv, Th and Td are thicknesses in the directions of minor, major and the diagonal axes, respectively, perpendicular to the tubular axis at each length-based position.

24. The cathode-ray tube as claimed in claim 23, wherein the following equation is satisfied:

$$0.35 \leqq Rid/Rod \leqq 0.67$$

wherein Riv and Rov are radii of inner and outer curvatures in the direction of the minor axis perpendicular to the tubular axis, respectively; Rih and Roh are radii of inner and outer curvatures in the direction of the major axis perpendicular to the tubular axis, respectively; and Rid and Rod are radii of inner and outer curvatures on corners approximating Riv and Rih, and Rov and Roh, respectively.

25. The cathode-ray tube as claimed in claim 22, wherein the following equation is satisfied:

$$0.3 \leqq Td_L/Tv_L \leqq 0.6$$

wherein $Tv_L$ is a thickness in the direction of the minor axis perpendicular to the tubular axis and $Td_L$ is a thickness in the direction of the diagonal axis perpendicular to the tubular axis, in the vicinity of a deflection base position.

26. The cathode-ray tube as claimed in claim 24, wherein the following equations are satisfied:

$$Tdt/Tvt \geqq Td_L/Tv_L \text{ and } Tdt/Tht \geqq Td_L/Th_L$$

wherein Tvt, Tdt and Tht are vertical, diagonal and horizontal thicknesses at inflection points of the yoke mounting part and the funnel, respectively; and $Th_L$, $Tv_L$ and $Td_L$ are horizontal, vertical and diagonal thicknesses at the deflection base position, respectively.

* * * * *